United States Patent [19]

Segerpalm et al.

[11] Patent Number: 5,004,304

[45] Date of Patent: Apr. 2, 1991

[54] ARRANGEMENT FOR DISPLACEABLE SUPPORTING ARTICLES OF FURNITURE

[75] Inventors: Hans Segerpalm, Hagersten; Ante Eklund, Vallentuna, both of Sweden

[73] Assignee: Swede Space Design AB, Stockholm, Sweden

[21] Appl. No.: 438,425

[22] PCT Filed: May 26, 1988

[86] PCT No.: PCT/SE88/00286

§ 371 Date: Nov. 13, 1989

§ 102(e) Date: Nov. 13, 1989

[87] PCT Pub. No.: WO88/09138

PCT Pub. Date: Dec. 1, 1988

[30] Foreign Application Priority Data

May 26, 1987 [SE] Sweden ..... 8702215

[51] Int. Cl.[5] ..... A47B 53/00

[52] U.S. Cl. ..... 312/201; 104/243; 104/244

[58] Field of Search ..... 103/243, 244, 245; 312/201

[56] References Cited

U.S. PATENT DOCUMENTS

| | | | |
|---|---|---|---|
| 379,905 | 3/1888 | Oehrle | 104/244 |
| 2,915,195 | 12/1959 | Crosby | 312/201 X |
| 3,801,176 | 4/1974 | Higbee | 312/201 X |
| 4,123,126 | 10/1978 | Querengasser | 312/201 |
| 4,160,611 | 7/1979 | Hveding | 104/244 X |
| 4,708,411 | 11/1987 | Peterman | 312/201 |

FOREIGN PATENT DOCUMENTS

| | | | |
|---|---|---|---|
| 914980 | 1/1963 | United Kingdom | 312/201 |

*Primary Examiner*—Joseph Falk

*Attorney, Agent, or Firm*—Sughrue, Mion, Zinn, Macpeak and Seas

[57] ABSTRACT

There is described an arrangement for movably and guidingly supporting articles or furniture, such as enclosed shelving systems, cabinets, cupboards and like articles. The arrangement includes a carriage (2) which is provided with guide wheels (8) and runners (6) and which is intended to be placed beneath the article of furniture to be supported. The arrangement further comprises at least two mutually parallel rails (3, 4) which are placed on a floor surface or like supporting surface and which co-act with the wheels and runners on the carriage (2) in moving and guiding the article of furniture carried thereby. The rails comprise a respective profiled section which presents a horizontal surface which is intended to be located at a desired height or level above the floor or like surface and to co-act with the carriage runners (6), and which presents two flank surfaces (7) which slope outwardly from the region of the horizontal surface (5) down towards the floor or like surface and which co-act with the carriage guide wheels (8). These flank surfaces also serve as drive-over ramps and stumble guards. Each rail section is preferably open towards the floor and has arranged internally therein devices which bear supportingly against the floor and which are effective in adjusting the level or the rail in relation to the floor surface.

8 Claims, 3 Drawing Sheets

ARRANGEMENT FOR DISPLACEABLE SUPPORTING ARTICLES OF FURNITURE

BACKGROUND OF THE INVENTION

The present invention relates to an arrangement which is intended for displaceably supporting and guiding articles of furniture such as enclosed shelving systems, cabinets, cupboards and like articles, and which is of the kind which comprises a carriage which is equipped with runners and guide wheels and which is intended to be placed beneath the article of furniture concerned, and which further comprises at least two mutually parallel rails which are placed on the floor or like support surface for co-action with the carriage wheels and runners.

Such furniture carrying arrangements are used to enable available spaces to be used more effectively, inter alia in offices, libraries, office records locations, and storerooms, and may, for instance, have the form of rail mounted shelving-systems which can be moved between different positions on said rails, e.g. so-called compact shelving systems or compact storage systems.

One drawback with present day systems of this kind is, inter alia, that the work involved in fitting the rails to the floor of a building is relatively complicated and expensive. The reason for this is because the rails must either be sunk into the floor or the floor surface located between the rails must be built-up, so as not to prevent the passage, for instance of other wheeled carriages across the rails.

Rails which are left proud on the floor surface also present a stumbling hazard, since they can be readily tripped over or stumbled on. When a space between the rails is built up, e.g. with an intermediate floor section, it is necessary to fit ramps to the outer rails, so as to enable carriages to be moved across the rails, and also to eliminate the risk of stumbling over rails which are proud, i.e. protrude above the surface of the floor. The channels or recesses formed in the floor for accommodating the rails also form not-readily cleaned dirt or dust traps. This also applies to the guide tracks in the actual rails themselves when using rails of the kind normally required for the guide wheels of known arrangements.

A further drawback with known arrangements of this kind is that the rails used therewith cannot be adjusted heightwise, e.g. to compensate for irregularities in the floor surface. Instead, it is necessary to pack the rails with inserts or shims of suitable thickness, which among other things further complicates the task of fitting the rails to the floor and aligning the rails. The result also detracts from the desired aesthetic appearance and hence the aforesaid intermediate flooring is also utilized to hide the support surface.

SUMMARY OF THE INVENTION

The main object of the present invention is to provide an arrangement for displaceably installing articles of furniture with which, inter alia, the aforesaid drawbacks are at least substantially overcome. This object is achieved with a rail system which consists of a rigid unitary structure which can be placed readily in any desired position on the floor or corresponding support surface and subsequently moved therefrom if required. The rails used herewith have an aesthetic form which will effectively guide therealong the carriage carrying said article of furniture and which eliminates the need for intermediate flooring.

In accordance with the invention an arrangement of the kind mentioned in the introduction is characterized in that the rails comprise a profiled section which presents a horizontal surface for co-action with the carriage runners at a desired distance above the floor surface and two flank surfaces which slope outwardly from the region of the horizontal surface down towards said floor surface and which co-act with the carriage guide-wheels, these inclined flank surfaces also serving as ramps which facilitate movement of objects across the rails and eliminate stumbling hazards, hereinafter referred to as cross-over ramps and stumble guards.

A carriage which is guided for movement on such rails can be easily moved therealong an is suitably constructed to carry the article of furniture concerned.

The carriage guide wheels are preferably arranged to run on the mutually facing, inner flank surfaces of a rail pair and preferably rotate about axes which extend substantially parallel with said flank surfaces.

In order to enable adjustments to be made to the vertical height of the rails above the floor surface, so as to compensate for irregularities in the floor surface, each rail preferably consists of an open profiled section having arranged internally thereof devices which support against the floor surface and which enable the height of respective rails to be adjusted. In this regard the arrangement preferably includes an elongated support plate which is intended to lie against the floor surface and which has vertically adjustable, upstanding rail support devices provided thereon.

According to one preferred embodiment each adjustment device includes a screw component which is in screw-thread engagement with a barrel-nut component, wherein either the nut or the screw component is attached to the plate and the other component co-acts with the rail in a manner to adjust the vertical height thereof above the floor. The adjustment component which co-acts with the rail to adjust its vertical height is conveniently rotatable and is guided in the rail so as to raise or lower the rail in response to the direction in which said component is rotated. The rail will also conveniently have provided therein an aperture through which said component can be reached for the purpose of rotating the same.

The rail adjusting device described above thus affords the important advantage of enabling the height of the rail above the floor surface to be adjusted as and when desired, thus even subsequent to fitting the rail, without needing to dismantle the entire rail system.

In order to enable the rail system to be readily placed on the floor surface, the rails of each rail pair are preferably interconnected by transverse spacer members.

The carriage may comprise a frame structure constructed from box-beams having runners which are sunk or let partially into two mutually opposing side beams, and in which a guide wheel is conveniently placed adjacent each runner and journalled in adjustable bracket structures which are attached to the carriage and which extend obliquely down towards and essentially parallel with the respective flank surfaces of the rails.

BRIEF DESCRIPTION OF THE DRAWINGS

The invention will now be described in more detail with reference to the accompanying drawings, in which.

DETAILED DESCRIPTION OF THE PREFERRED EMBODIMENT

Figure 1:
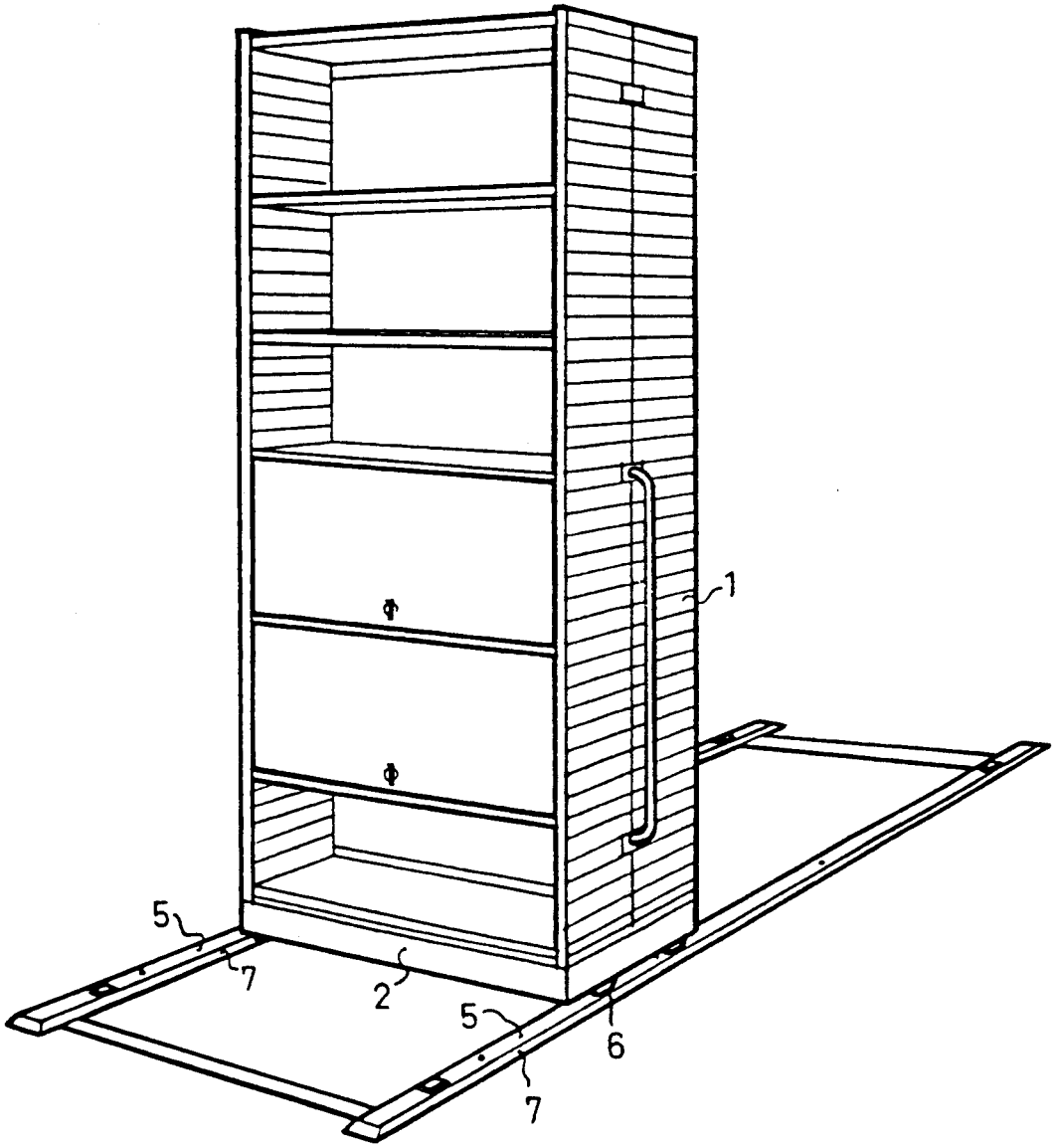
FIG. 1 illustrates an enclosed shelving system movably mounted on a rail system constructed in accordance with the invention.

FIG. 1 illustrates an enclosed or compact shelving system 1 placed on a carriage 2 which can be moved along two rails 3 and 4. The rails comprise profiled sections which are open towards the floor surface or like support surface and which present an upper horizontal surface 5 for co-action with runners 6 journalled on the carriage 2, and ramp or flank surfaces 7 which slope outwardly down towards the floor surface and which co-act guidingly with guide wheels (not visible in FIG. 1) running on the inwardly facing surfaces of respective rails. The rails 3 and 4 may have a very low vertical extension, or height, which in conjunction with the inclined flank surfaces 7 provides a rail structure which can be placed directly on the surface of the floor or like support surface without obstructing the passage of other wheeled carriages or presenting a serious stumbling hazard.

Figure 2:
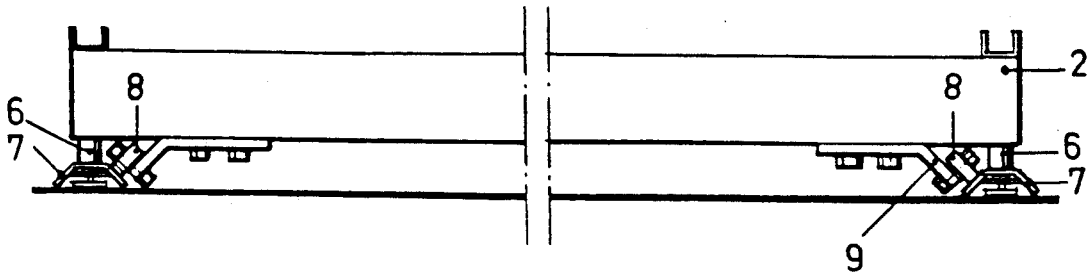
FIG. 2 is a front view which illustrates the carriage carrying the shelving system of FIG. 1 and associated rails.

FIG. 2 is a front view of the carriage 2 which has arranged along side edges thereof two U-shaped channels for supporting the side walls of the enclosed shelving system illustrated in FIG. 1. The carriage runners 6 run on the upper horizontal surfaces of the floor rails, whereas the guide wheels 8 mounted on the underside of the carriage co-act guidingly with the inwardly facing flank surfaces 7 of respective rails. The guide wheels 8 are journalled on bracket structures 9 which project outwardly at right angles, or substantially at right angles to the flank surfaces 7, so that the wheels will rotate about axes which extend parallel or substantially parallel with the flank surfaces 7. The bracket structures 9 are adjustably mounted on the carriage 8, in the illustrated embodiment with the aid of bolts which are accommodated in elongated slots or like apertures which will permit positional adjustments to be made to said brackets. A carriage which is supported in this manner can be readily moved along the rails with all movement of the carriage precisely controlled. Thus, there is no tendency of the enclosed shelving system to stick or jam on the rails.

Arranged between the floor surface and the rails are suitable devices for adjusting the height or level of the rails above the floor, these adjustment devices being described hereinafter in greater detail with reference to FIG. 4.

Figure 3:
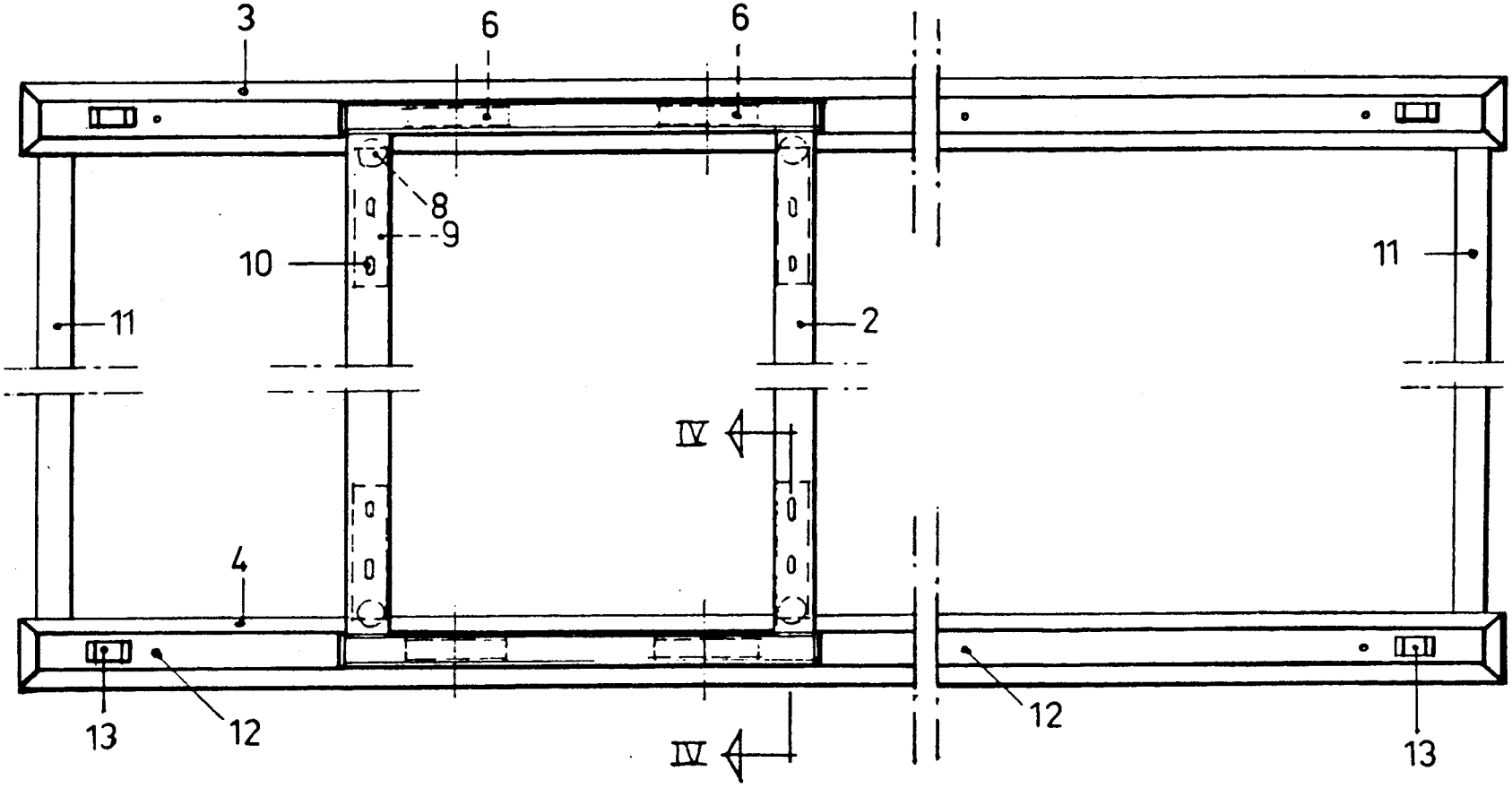
FIG. 3 is a horizontal view of a carriage and an associated rail system according to the invention.

FIG. 3 is a horizontal, schematic view of the carriage 2. The illustrated carriage comprises a box-beam frame structure, in which the runners 6 are set partially into two mutually opposing side beams of the frame. As will be seen, each runner 6 has a guide wheel 8 located adjacent thereto, the runners and wheels, being shown here in broken lines. Reference numeral 10 identifies slot-like apertures provided in both the bracket structures and in the carriage beams so as to enable adjustments to be made to the settings of the guide wheels.

The rails 3,4 of each pair of rails are interconnected by transverse spacer members in the form of flat irons 11, which hold the rails in an exactly parallel and rigid relationship and enable the rail construction to be placed loosely, in the form of a structural unit, on the floor surface and subsequently re-located thereon if so desired. Reference numeral 12 in FIG. 3 identifies apertures through which adjustment means for adjusting the height of the rails relative to the floor surface can be reached with an appropriate tool. Reference numeral 13 identifies suitable end stops for the carriage 2.

Figure 4:
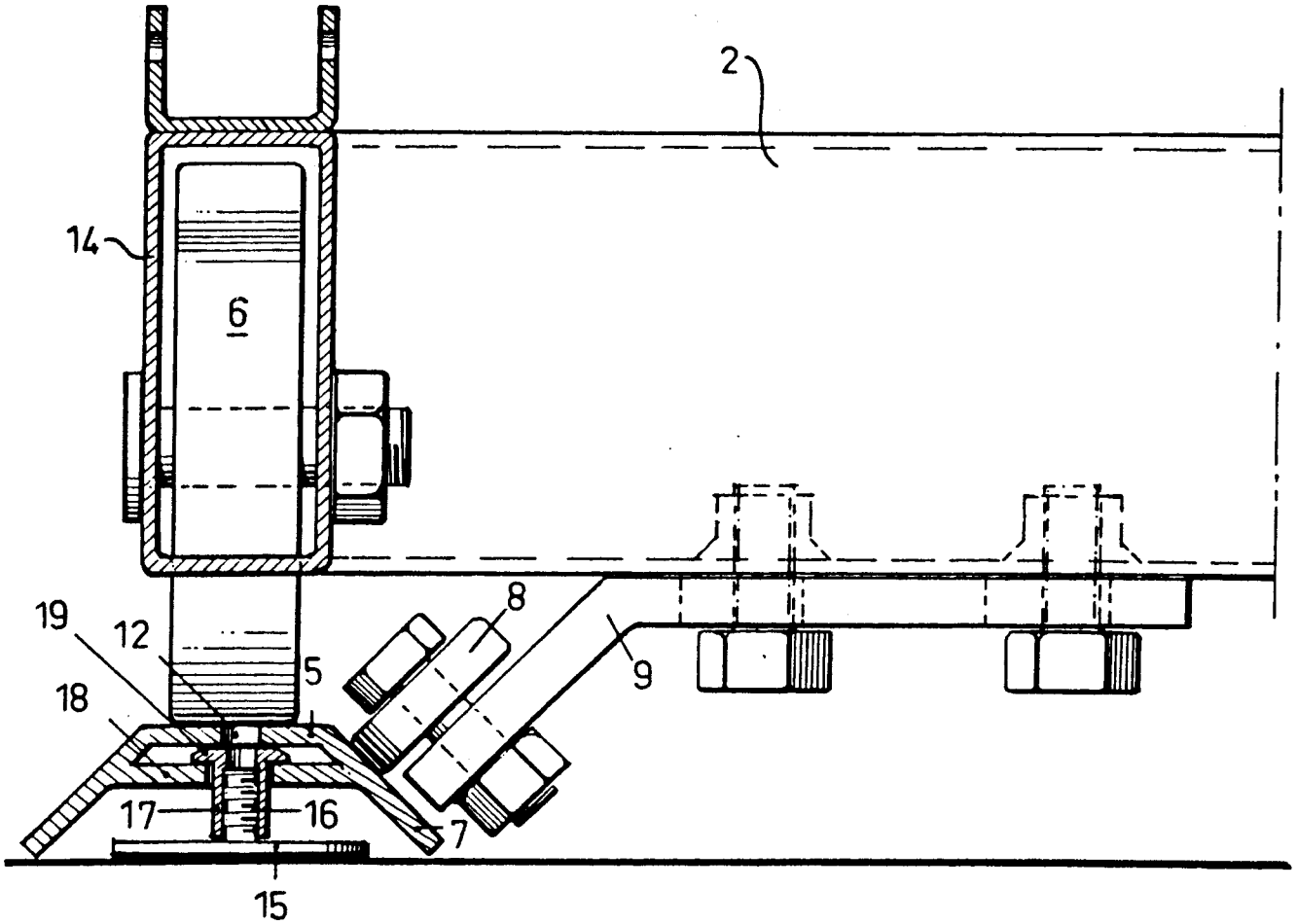
FIG. 4 is a sectional view taken on the line IV—IV in FIG. 3.

FIG. 4 is a sectional view taken on the line IV—IV in FIG. 3 and illustrates the carriage 2 and one runner 6 which is set into one side beam 14 of the carriage structure. The downwardly facing defining surface of the beam 14 has formed therein an elongated opening through which the runner 6 can engage the horizontal surface of its associated rail. The Figure shows the mutual co-action between the runner 6 and the horizontal surface 5 and between the guide wheel 8 and the inclined flank surface 7 of the rail.

In order to adjust the height of the rail in relation to the supporting floor surface, e.g. to compensate for irregularities in the floor, the rail of the illustrated embodiment includes an elongated support plate 15 which is intended to lie in abutment with the floor and on which upstanding screws 16 are arranged at equidistances apart. The screws 16 co-act with barrel nuts 17 which are guided for rotation in a transverse spacer plate 18 arranged in the rail. The barrel nuts 17 have a head portion 19 which can be brought into supportive co-action with the upper horizontal surface 5 of the rail such as to raise the rail or optionally, in conjunction with the spacer plate 18, to lower said rail. The nut 19 can be rotated with the aid of a suitable tool, e.g. a hexagonal spanner or Allen key inserted through the aperture 12 in the rail.

This construction enables the level of the horizontal surfaces of respective rails relative to the floor surface to be adjusted readily, subsequent to placing the rail on said surface, and also enables subsequent adjustments to be made if so required. The spacer plate 18 will also stabilize the rails in a manner which will allow the flank surfaces to serve as ramps which facilitate the passage of other wheeled carriages or the like across the rails, i.e. drive-over ramps, even when a rail is lifted slightly away from the floor. Thus, no additional, obstructive or disturbing inserts are required to lift the rails of the inventive arrangement and any gaps or joints between the flank surfaces of the rails and the floor can be filled or covered with a plastic jointing compound. This will provide an impervious covering against the ingress of dirt, dust, etc., and affords a beneficial arrangement which locks difficultly cleaned spaces in which dust can collect.

The embodiment described in the aforegoing is a preferred embodiment which exemplifies the general concept of the invention. The arrangement can be operated manually and also with the aid of hand-operated or motor-driven crank cevices in a conventional manner. The illustrated arrangement can also be modified without departing from the scope of the invention defined in the following claims. For example the devices used to adjust the level of the rails in relation to the floor surface may have a different construction to that described and illustrated, and the illustrated adjustment devices may be attached differently to the manner shown. For example, the positions of the nuts and sleeves may be reversed. Other easily adjustable devices capable of adjusting the height of the rails above the floor surface can also be used.

We claim:

1. An arrangement for supporting an guiding articles of furniture, such an enclosed shelving systems, cabinets and the like, comprising:

(a) a pair of parallel, horizontally disposed, laterally spaced rails (3,4) disposed on a floor surface or the like, each rail having a cross-section defining a flat, horizontal upper surface (5) flanked by and integral at opposite side edges with a pair of ramp surfaces (7) sloping outwardly and downwardly toward the floor surface at an acute angle, (b) a carriage (2) having a width at least equal to the lateral spacing between the rails, and adapted to carry the articles of furniture, (c) a plurality of runner wheels (6) individually journalled to opposite undersides of the carriage for rolling engagement with the upper surfaces of the rails, and (d) a plurality of guide wheels (8) individually journalled to opposite undersides of the carriage for rolling engagement with inner, facing ones of the ramp surfaces of the rails, an axis of each guide wheel extending substantially parallel to an associated one of the ramps surfaces, (e) wherein the ramp surfaces enable the transverse passage of wheeled carriages and minimize any stumbling hazard presented by the rails.

2. An arrangement according to claim 1, wherein each rail comprises a profiled section open towards the floor surface and includes within said section adjustment means (15, 16, 17) which bear against said floor surface for adjusting the vertical height of the rail in relation to the floor surface.

3. An arrangement according to claim 2, wherein the adjustment means comprise an elongated support plate (15) for abutment with the floor surface, and upstanding devices (16,17) which extend vertically from the plate (15) and which can be adjusted to a desired height above said plate.

4. An arrangement according to claim 3, wherein the upstanding devices include a screw (16) and a barrel-nut (17) in screw engagement with said screw, wherein one of the screw and the barrel-nut is attached to the support plate and another of the screw and the barrel-nut co-acts with a rail.

5. An arrangement according to claim 4, wherein the another upstanding device is a rotatable and is guided in the rail to lift or lower the rail in response to the direction or rotation thereof; and the rail has an aperture (12) through which said another upstanding device can be reached for rotation.

6. An arrangement according to claim 1, wherein the rails are interconnected by transverse spacer members (11) to enable the arrangement to be placed as a unit in any desired position on the floor surface.

7. An arrangement according to claim 1, wherein the carriage comprises a frame structure constructed from box beams (14); and the runner wheels are partially set into two mutually opposing beams of said frame structure.

8. An arrangement according to claim 7, wherein one guide wheel is located adjacent each runner wheel; and the guide wheels are journalled in bracket structures (9) adjustably mounted on the carriage, and which incline downwardly towards and are substantially perpendicular to associated ramp surfaces of the rails.

* * * * *